US006658901B2

(12) United States Patent
Uhlin et al.

(10) Patent No.: US 6,658,901 B2
(45) Date of Patent: Dec. 9, 2003

(54) INDICATION DEVICE FOR A LAUNDRY WASHING MACHINE

(75) Inventors: Göran Uhlin, Lagan (SE); Sten Håkan Almström, Ljungby (SE)

(73) Assignee: Aktiebolaget Electrolux, Stockholm (SE)

( * ) Notice: Subject to any disclaimer, the term of this patent is extended or adjusted under 35 U.S.C. 154(b) by 44 days.

(21) Appl. No.: 10/008,141

(22) Filed: Nov. 13, 2001

(65) Prior Publication Data

US 2002/0062668 A1 May 30, 2002

(30) Foreign Application Priority Data

Nov. 24, 2000 (SE) ..... 0004327

(51) Int. Cl.[7] ..... D06F 37/28

(52) U.S. Cl. ..... 68/3 R; 68/13 R; 134/200; 277/320

(58) Field of Search ..... 277/318, 320, 277/609, 630, 641, 910, 928; 68/3 R, 13 R, 139; 134/200

(56) References Cited

U.S. PATENT DOCUMENTS 4,420,970 A * 12/1983 Organi
5,090,871 A * 2/1992 Story et al.
5,267,455 A 12/1993 Dewees et al.
5,280,924 A * 1/1994 Burgess
6,027,143 A * 2/2000 Berg et al.
6,079,750 A * 6/2000 Kacines
6,349,947 B1 * 2/2002 Turner et al. ..... 277/641

FOREIGN PATENT DOCUMENTS

EP 1 063 342 A2 12/2000
JP 63-234198 * 9/1988

* cited by examiner

*Primary Examiner*—Frankie L. Stinson
(74) *Attorney, Agent, or Firm*—Pearne & Gordon LLP

(57) ABSTRACT

An indication device for a laundry washing machine, which has a treatment chamber (12) for laundry that can be pressurized in order to treat the laundry with a cleaning agent. The treatment chamber is provided with an opening (13), which in the treatment position is covered by a door (16) fixed to a surrounding housing (11) and is sealed from the housing by means of a sealing arrangement. The sealing arrangement comprises at least two gaskets (19, 20) surrounding the opening and forming an intermediate space (23) that via a channel (24) is arranged to communicate with atmosphere.

8 Claims, 1 Drawing Sheet

INDICATION DEVICE FOR A LAUNDRY WASHING MACHINE

BACKGROUND OF THE INVENTION

This invention relates to an indication device for a laundry washing machine. The washing machine comprises a treatment chamber for laundry that is pressurized in order to treat the laundry with a cleaning agent. The chamber has an opening, which in the treatment position is covered by a door fixed to a surrounding housing and is sealed from the housing by means of a sealing arrangement.

Laundry washing machines of the type mentioned above are previously known and have been developed because of environmental reasons to replace chemical washing machines in which, for instance, trichloroethylene or perchloroethylene are used. In these alternative machines, a cleaning agent such as carbon dioxide is used in liquid state. However, there is a complication with respect to this technique since the washing chamber has to be under pressure during the treatment procedure. Machines of this type are described, for instance, in U.S. Pat. No. 5,267,455.

The sealing of the door, in particular the sealing device that is arranged around the fill opening of the machine, is often exposed to wear. Because of the high pressure, there is a risk for gas leakage from the treatment chamber, which would not be observed by people around the machine.

BRIEF SUMMARY OF THE INVENTION

The invention provides a simple and cost-effective sealing arrangement comprising an indication means intended to call upon the attention of people around a laundry washing machine that a gas leak from the treatment chamber has occurred. This is achieved by means of a device comprising a treatment chamber for laundry with an opening, which in a treatment position, is covered by a door fixed to a surrounding housing and is sealed from the housing by means of a sealing arrangement. The chamber is pressurized to treat laundry with a cleaning agent, and the sealing arrangement is provided with at least two gaskets surrounding the opening and forming an intermediate space. The space is arranged to communicate with the atmosphere via a channel such that a sound indication is achieved if there is gas leakage to the intermediate space.

BRIEF DESCRIPTION OF THE DRAWINGS

An embodiment of the invention will now be described with reference to the accompanying figures in which.

DETAILED DESCRIPTION OF THE INVENTION

Figure 1:
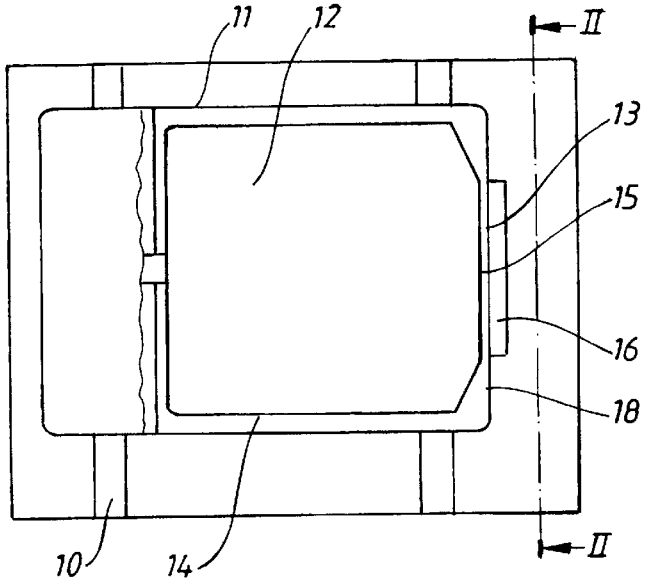
FIG. 1 is a cross-sectional view of a machine with an embodiment of the invention.
Figure 2:
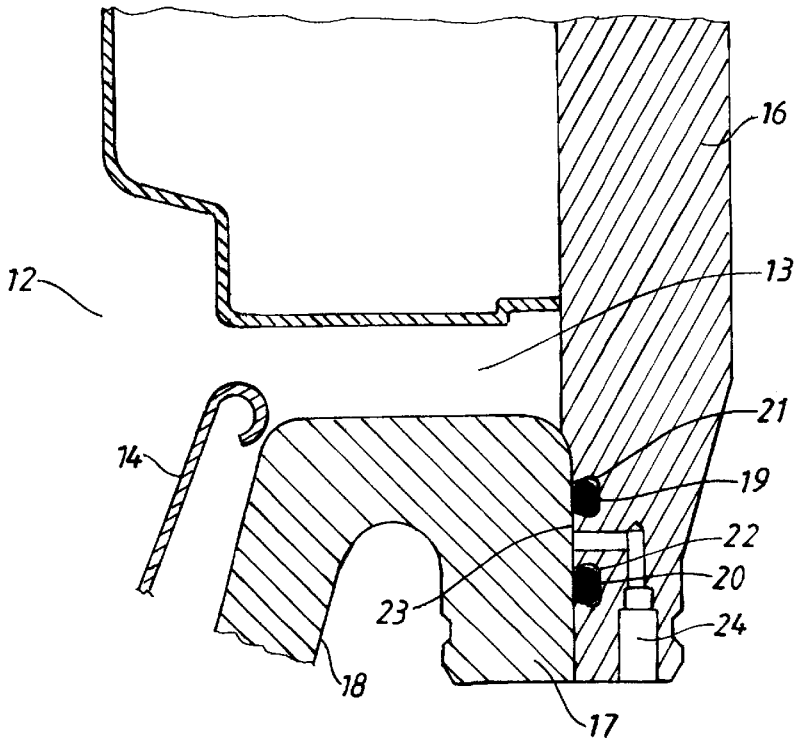
FIG. 2 is view of an enlargement of a section through part of the door portion of the machine in FIG. 1.

The laundry washing machine shown in FIG. 1 comprises a frame 10 supporting a pressure housing 11 that forms a treatment chamber 12 with a circular fill opening 13. The chamber 12 encloses a drum 14 that is rotatably supported by means of a horizontal shaft extending through a rear wall of the chamber 12 and which is driven by an electric motor (not shown). The drum 14 has, in a conventional manner, an opening 15, which is mainly as large as the fill opening 13 and coaxial with it. During the washing process, the fill opening 13 is covered by a door 16, which via a hinge (not shown), is fastened to a flange portion 17 surrounding the opening of the front wall 18 of the housing 11.

The door is sealed from the flange part 17 by means of a sealing arrangement comprising two concentric gaskets 19 and 20 designed as O-rings. The first O-ring 19 has a smaller diameter than the second O-ring 20. Each O-rings is inserted into a groove 21 and 22, respectively, in the door and is maintained in the groove because of the dovetail shape of the groove. An intermediate space 23 is located between the two O-rings and is via a channel or gas passage 24 connected to atmosphere.

The sealing arrangement operates in the following manner. When the door 16 is closed and pressurized gas, for instance, liquid carbon dioxide, has filled into the treatment chamber 12, the inner gasket 19 seals the treatment chamber from the surroundings. Should any damage occur on the gasket 19, gas will leak out into the space 23 and flow through the channel 24. Since the channel is designed such that it also serves as a restriction for small amounts of gas leaking to the space 23, a characteristic whistling sound occurs, thus, indicating for the surroundings that the sealing effect is unsatisfactory and that measurements should be taken to repair the fault.

The described sealing arrangement is not limited to the described use at the fill opening of a laundry washing machine, but may be used for other doors or details arranged in the wall of the treatment chamber.

While the invention has been described with reference to a specific embodiment, various changes may be made and equivalents may be substituted for elements thereof by those skilled in the art without departing from the scope of the invention. In addition, other modifications may be made to adapt a particular situation or method to the teachings of the invention without departing from the essential scope thereof. The present invention herein is not to be construed as being limited, except insofar as indicated in the appended claims.

What is claimed is:

1. An indication device for a laundry washing machine, the washing machine comprising: a treatment chamber (12) for laundry with an opening (13) which in a treatment position is covered by a door (16) fixed to a surrounding housing (11) and is sealed from the housing by means of sealing arrangement, and the chamber (12) is pressurized to treat laundry with a cleaning agent, and the sealing arrangement comprises at least two gaskets (19, 20) surrounding the opening and forming an intermediate space (23) which via a channel (24) is arranged to communicate with atmosphere such that a sound indication is achieved by gas entering into the intermediate space and flowing through the channel to atmosphere if there is a gas leakage into the intermediate space.

2. An indication device according to claim 1, wherein said opening (13) forms a fill opening to the treatment chamber.

3. Indication device according to claim 1, wherein the opening (13) is mainly circular.

4. An indication device according to claim 1, wherein the gaskets (19, 20) comprise O-rings having different diameters.

5. An indication device according to clam 1, wherein the channel (24) is designed such that it serves as a restriction for out flowing gas.

6. An indication device according to claim 5, wherein a characteristic whistling sound is produced by gas flowing through the restriction.

7. An indication device for a laundry washing machine comprising:

a treatment chamber for laundry;

an opening in the treatment chamber;

a housing surrounding the treatment chamber;

a cover for the chamber opening; and a sealing arrangement engaging the chamber opening and the cover to seal the chamber from the housing when the chamber contains pressurized gas, the sealing arrangement comprises at least two gaskets surrounding the opening, an intermediate space formed between the at least two gaskets, and a channel connecting the intermediate space to atmosphere, wherein the channel is designed to serves as a restriction for out flowing gas, and wherein gas leaking into the intermediate space flows through the restriction and produces an audible sound indicating there is gas leakage from the treatment chamber.

8. An indication device according to claim 7, wherein a characteristic whistling sound is produced by gas flowing through the restriction.

* * * * *